US008094771B2

(12) United States Patent
Tsang et al.

(10) Patent No.: US 8,094,771 B2
(45) Date of Patent: Jan. 10, 2012

(54) NUCLEAR VOLTAIC CELL

(75) Inventors: Francis Yu-Hei Tsang, Idaho Falls, ID (US); Tristan Dieter Juergens, Telluride, CO (US); Yale Deon Harker, Idaho Falls, ID (US); Kwan Sze Kwok, Brooklyn, NY (US); Nathan Newman, Scottsdale, AZ (US); Scott Arden Ploger, Idaho Falls, ID (US)

(73) Assignee: Global Technologies, Inc., Idaho Falls, ID (US)

( * ) Notice: Subject to any disclaimer, the term of this patent is extended or adjusted under 35 U.S.C. 154(b) by 1011 days.

(21) Appl. No.: 10/720,035

(22) Filed: Nov. 21, 2003

(65) Prior Publication Data

US 2011/0274233 A1 Nov. 10, 2011

(51) Int. Cl.
*G21D 7/00* (2006.01)

(52) U.S. Cl. ..... 376/320; 376/317; 136/202; 322/88

(58) Field of Classification Search ..... 376/317, 376/320–323; 136/202; 429/111, 11; 310/300–305; 322/88

See application file for complete search history.

(56) References Cited

U.S. PATENT DOCUMENTS 2,900,535 A * 8/1959 Thomas ..... 310/302
3,344,289 A * 9/1967 Knight ..... 310/301
3,706,893 A 12/1972 Olsen et al.
3,934,162 A 1/1976 Adler et al.
3,939,366 A 2/1976 Ato et al.
4,010,534 A * 3/1977 Anthony et al. ..... 438/19
4,024,420 A * 5/1977 Anthony et al. ..... 310/303
4,084,044 A 4/1978 Heller et al.
4,127,449 A 11/1978 Heller et al.
4,169,917 A * 10/1979 Baker et al. ..... 429/26
4,212,179 A 7/1980 Juergens
4,259,419 A 3/1981 Uba et al.
4,493,221 A 1/1985 Stieg et al.
4,521,498 A 6/1985 Juergens
4,592,972 A 6/1986 Juergens et al.
4,606,982 A 8/1986 Nelson et al.
4,835,433 A 5/1989 Brown
5,045,086 A 9/1991 Juergens
5,047,300 A 9/1991 Juergens
5,082,505 A * 1/1992 Cota et al. ..... 136/253
5,087,533 A 2/1992 Brown
5,198,313 A 3/1993 Juergens
5,260,621 A * 11/1993 Little et al. ..... 310/303

(Continued)

OTHER PUBLICATIONS

Metal-Semiconductor Ohmic and Schottky Contacts, Brigham Young University, available @ http://www.ee.byu.edu/cleanroom/ohmic-schottky.phtml, last accessed Nov. 14, 2005.*

(Continued)

*Primary Examiner* — Ricardo Palabrica
(74) *Attorney, Agent, or Firm* — Schwegman, Lundberg & Woessner, P.A.

(57) ABSTRACT

The invention describes a product and a method for generating electrical power directly from nuclear power. More particularly, the invention describes the use of a liquid semiconductor as a means for efficiently converting nuclear energy, either nuclear fission and/or radiation energy, directly into electrical energy. Direct conversion of nuclear energy to electrical energy is achieved by placing nuclear material in close proximity to a liquid semiconductor. Nuclear energy emitted from the nuclear material, in the form of fission fragments or radiation, enters the liquid semiconductor and creates electron-hole pairs. By using an appropriate electrical circuit an electrical load is applied and electrical energy generated as a result of the creation of the electron-hole pairs.

10 Claims, 11 Drawing Sheets

U.S. PATENT DOCUMENTS

| | | | | |
|---|---|---|---|---|
| 5,606,213 | A * | 2/1997 | Kherani et al. | 310/303 |
| 5,677,078 | A | 10/1997 | Juergens et al. | |
| 5,721,462 | A | 2/1998 | Shanks | |
| 5,859,484 | A * | 1/1999 | Mannik et al. | 310/303 |
| 5,895,728 | A | 4/1999 | Walker et al. | |
| 6,004,689 | A | 12/1999 | Walker et al. | |
| 6,118,204 | A * | 9/2000 | Brown | 310/303 |
| 6,238,812 | B1 | 5/2001 | Brown et al. | |
| 6,700,298 | B1 * | 3/2004 | Snyder et al. | 310/305 |
| 6,944,254 | B2 | 9/2005 | Kormuth et al. | |
| 6,949,865 | B2 * | 9/2005 | Gadeken | 310/303 |
| 7,193,237 | B2 * | 3/2007 | Aramaki et al. | 257/40 |

OTHER PUBLICATIONS

Denninger, Schottky Contacts, Semiconductor physics 1 , WS 2001/2002 Denninger, available @ http://www.ee.sc.edu/research/SiC_Research/papers/schottkycontacts.pdf,last accessed Nov. 14, 2005.*

Godlevsky et al., Ab Initio Molecular Dynamics Simulation of Liquid CdTe and GaAs: Semiconducting versus Metallic Behavior, Department of Chemical Engineering and Materials Science, Minnesota Supercomputer Institute, University of Minnesota, May 13, 1998.*

Yu et al., Molecular-dynamics study of surface segregation in liquid semiconductor alloys, Department of Physics, The Ohio State University, Columbus, Ohio, May 16, 1997.*

Price et al., Rotator Phases in Narrow-Gap Semiconductors, Argonne National Laboratory, Dec. 1993.*

Kulkami et al., Ab initio molecular-dynamics study of the structural and transport properties of liquid germanium, Department of Physics, The Ohio State University, Columbus, Ohio, Sep. 23, 1996.*

Matthiesen et al., Diffusion Processes in Molten Semiconductors, Mar. 2002, available @ http://zeta.lerc.nasa.gov/expr3/dpims.htm, last accessed Nov. 15, 2005.*

Enderby et al., Liquid Semiconductors, Rep. Prog. Phys. 53 (1990) 85-179. Printed in the UK, available @ http://ej.iop.org/links/q48/dryRcZ58u8dN,T6YTA2whQ/rpv53i2p85.pdf, last accessed Nov. 14, 2005.*

Greuter, "Electronic surface properties of a liquid semiconductor selenium," J. Phys.C:Solid State Phys. 18(1985), 2527-2537.*

Palmer, D. W., Point Defects and Irradiation Damage Deep Level Transient Spectroscopy, www.semiconductors.co.uk/dwpress02.htm, Sep. 9, 2003.

http://www.rexresearch.com/nucell/nucell.htm, web pages provided through the web site http://www.rexresearch.com, various dates: 1980's, Mar. 5, 1987, May/Jun. 1990, Jan. 18, 1990, Aug. 4-9, 1991, Nov. 17, 1989, May 30, 1989, printed out and attached as pp. 1-31.

"4-pocket Electron Bean Evaporator", *e-flux4, tec tra*, 5 Pages.

"Annealing (Metallurgy)", *Wikipedia*, http://en.wikipedia.org/wiki/Annealing_%28metallurgy%29, 1 Page.

"Carbon Coaters, Sputter Coaters and Turbo Sputter Coaters", *Electron Microscopy Sciences*, http://www.emsdiasum.com/microscopy/products/equipment/carbon_coaters.aspx, 8 Pages.

"E-beam Evaporator", Brigham Young University, Department of Electrical & Computer Engineering, http://www.ee.byu.edu/cleanroom/ebeam.phtml, (Observed Nov. 7, 2006), 2 Pages.

"E-beam Evaporators", *Oxford Scientific*, http://www.oxsci.com/pages/products/evaporators/index.htm, (Obersved Nov. 7, 2006), 5 Pages.

"Laboratory Sputter Coating Equipment", *Thin Film Coating, Deposition & Sputtering Equipment*, http://www.emitech.co.uk/sputtering-coating.htm, 3 Pages.

"Rototherm—Thin Flim Evaporator", *Artisan Industries, Inc.*, http://www.artisanind.com/chemical/rototherm.htm (Observed Nov. 7, 2006) 2 Pages.

"Sputter Coating Technical Brief", *Quorum Technologies, Polaron, Issue 1, Document No. TB-Sputter*, 13 Pages.

"Sputter-Coater high vaccuum coating system for thin flim deposition", http://www.tectra.de/spuco.htm, (Observed Nov. 7, 2006), 5 Pages.

Allgaier, R. S., "Interpretation of transport Measurements in Electronically Conducting Liquids", *Physical Review*, vol. 185, No. 1, (Sep. 5, 1969), 227-244.

Brillson, Leonard J., "Contacts to Seimiconductors", *Contacts to Semiconductors, Fundamentals and Technology, Xerox Corporation, Noyes Publications*, New Jersey, (1993).

Bullock, Alan, et al., "The Harper Dictionary of Modern Thought,", *The Harper Dictionary of Modern Thought, Harper & Row*, New York, (1977),p. 25.

Considine, Glenn D., *Encyclopedia of Chemistry, Fifth Edition, Van Nostrand's, John Wiley & Sons. Inc.*, (2005).

Cutler, Melvin, "Experimental Methods", *Chapter 4, Liquid Semiconductors, Academic Press Inc.*, (1977), 7 Pages.

Farrell, Martin V., et al., "Coupling of Buoyant Convections in Boron Oxide and a Molten Semiconductor in a Ventical Magnetic Field", *Journal of Heat Transfer*, vol. 124, (Aug. 2002), 643-649.

Gearhart, Steven S., et al., "A Monolithic 250 GHz Schottky-Diode Receiver", *IEEE Transactions on Microwave Theory and Techniques*, vol. 42, No. 12, (Dec. 1994), 2504-2511.

Ghosh, P. K., et al., "Electronic transport in Liquid and solid sulphur", *J. Phys. C* (*Proc. Phys. Soc.*), Series 2, vol. 1, (1968), 1347-1358.

Glazov, Vasilii M., et al., "Liquid Semiconductors", *Liquid Semiconductors, Plenum Press*, New York, (1969).

Gobrecht, H., et al., "Electrical properties of liquid selenium up to 1300K", *J. Phys. C: Soild St. Phys.*, vol. 4, (1971), 2247-2253.

Gray, H. J., et al., "A New Dictionary of Physics", *A New Dictionary of Physics, Second Edition*, Longman London, (1975), p. 23.

Greacen, Chris, "How Photovoltaics Cells Work", *Photovoltaics, Home Power #23*, (Jun.-Jul. 1991), 37-39.

Greenwood, N. N., et al., "Chemistry of the Elements", *Chemistry of the Elements, Pergamon Press*, New York, (1984), p. 1121.

Harrell, William R., "Aluminum schottky contacts to n-type 4H-SiC", *Look Smart*, http://flndarticles.com/p/articles/mi_ga3776/is_200210/ai_n9137011, (Oct. 2002), 4 pages.

Hartke, J. L., et al., "Electronic States in Vitreous Selenium", *Physical Review*, vol. 139, No. 3A, (Aug. 2, 1965), A970-A980.

Hosokawa, Shinya, et al., "Electronic Properties of Liquid Selenium Containing Alkali and Halogen Impurities", *Journal of the Physical Society of Japan*, vol. 54, No. 12. (Dec. 1985), 4717-4725.

Ioffe, A. F., et al., "Non-Crystalline, Amorphous, and Liquid Electronic Semiconductors", *Progress in Semiconductors*, vol. 4, (1960), 239-291.

Jamali, Behnam, et al., "Design and optimisation of Schottky diodes in CMOS tehnology with application to passive RFID systems", *School of Electrical and Electronics Engineering, University of Adelaide, S.A. 5005*, Australlia, 9 Pages.

Knoll, Glenn F., "Radiation Detection and Measurement", *Radiation Detection and Measurement, Third Edition, John Wiley & Sons, Inc.*, New York, (2000).

Koslowski, Thorsten, et al., "Modified small-world networks as models of liquid and amorphous selenium", *Physical Review B*, vol. 66 (064205), (2002), 7 Pages.

Kresse, G., et al., "Defects in liquid selenium", *Physical Review B*, vol. 59, No. 5, (1998), 3501-3513.

Lee, Ching-Ting, "Performance characterization of InGaP Schottky contact with ITO transparent electrodes", *Look Smart*, http://www.findarticles.com/p/articles/mi_qa3776/is_199809/ai_n8812313, (Sep. 1998), 5 Pages.

Li, Qiang, et al., "Fabrication and Modeling of Schottky Diode: Integrated in standard CMOS process", *State Key Lab of ASIC & System, Fudan University*, Shang Hai 200433,8 Pages.

Li, Meicheng, et al., "The Dependence of Electrical Characterization on Interface Structure of PtSi/strained-Si1-x-Gex/Si Schottky Diodes", *Advanced Nanomaterials and Nanodevices, Eight International conference on electonic materials*, China, (Jun. 2002), 278-289.

Merrett, J. N., "Fabrication of self-aligned graded junction termination extensions with applications to 4H-SiC P-N diodes", *Look Smart*, http://www.findartilcles.com/p/articles/mi_ga3776/is_200206ai_n9123173, (Jun. 2002), 5 Pages.

Mizobuchi, Yuzo, et al., "Photogeneration of Charge Carriers in a-sulfur", *Journal of the Physical Society of Japan*, vol. 31, No. 1, (Jul. 1971), 155-163.

Monch, W., "Semiconductor Surfaces and Interfaces", *Semiconductor Surfaces and Interfaces*, Third Edition, Springer, (2001).
Mott, N. F., et al., "States in the gap and recombination in amorphous semiconductors", *Philosophical Magazine*, vol. 32, (1975), 961-996.
Ping, A. T., "Characterization of reactive ion etching-induced damage to n-GaN surfaces using Schottky diodes", *Look Smart*, http://www.findarticles.com/p/articles/mi_qa3776/is_199703/ai_n8756708, (May 1997), 5 Pages.
Queheillalt, Douglas T., et al., "Laser ultrasonic sensing of the melting and solidification of cadmium telluride", *Journal of Crystal Growth*, vol. 225, (2001), 34-44.
Ratakonda, D., "Ohmic contacts formation of Silicon Schottky Diodes by Screen Printing and Rapid Isothermal Processing", *Look Smart*, http://www.findarticles.com/P/articles/mi_qa3776/is_199805/is_n8797486, (May 1998), 3 Pages.
Regel, A. R., et al., "Thermal Conductivity of Salt, Metal and Semiconducting Melts", *Phys. stat. solidi*, vol. 5., (1971) 13-57.
Rhines, Frederick N., "Phase Diagrams in Metallurgy, Their Development and Application", *Phase Diagrams in Metallurgy, Their Development and Application, McGraw-Hill book company*, New York, (1956), p. 29.
Zingaro, Ralph A., et al., "Selenium", *Selenium, Van Nostrand Reinhold Company*, New York, (1977).
Enderby, J. E., "Liquid semiconductors", *Rep. Prog. Phys.*, 53, (1990), 85-179.
"U.S. NRC: Our Governing Legislation", 1-4 pgs.
Patel, Jagdish, et al., "Alpha-Voltaic Sources Using Liquid Ga as Conversion Medium", *NASA Tech Briefs, Technical Support Package*, NPO—30322, 5 Pages.
"Fuel enrichment capsule from ORNL molten salt reactor", *Oak Ridge National lab archives*, (Nov. 2001), 13 pgs.
"Molten salt reactors based on the Th-US3 fuel cycle", http://lpsc.in2p3.fr/gpr/english/MSR/MSR.html, (Nov. 2001),13 pgs.

* cited by examiner

NUCLEAR VOLTAIC CELL

GOVERNMENT RIGHTS

This invention was made with U.S. Government support under a cost-plus-fixed-fee contract, contract number N00014-02-C-0386 awarded by the Office of Naval Research. The U.S. Government has certain rights in the invention.

FIELD OF THE INVENTION

The invention relates primarily to a method of and a device for generating electrical power directly from nuclear power, and more particularly to using liquid semiconductors as a means for efficiently converting nuclear energy, either nuclear fission and/or radiation energy, directly into electrical energy.

BACKGROUND OF THE INVENTION

Ever since the potential for generating electrical power from nuclear reactions was recognized, scientists have strived to devise the best methods of harnessing nuclear power and putting it to practical use. The main objectives of such research have been to create the most efficient methods of power conversion, power converters that can generate electrical power from nuclear power sources for sustained periods of time without maintenance, and smaller, more manageable power converters that can be used as everyday power sources. The sources of nuclear energy that scientists have sought to harness include nuclear fission (the splitting of atoms), radiation (the emission by radiation of alpha, beta or gamma rays) and nuclear fusion (the fusing of atoms). The present invention is designed to generate electrical power from energy produced from nuclear fission and/or radiation. For the purposes of this document, the following terms shall have, in addition to their generally accepted meaning, the meanings listed below:

(a) the term "nuclear material" or "nuclear materials" refers to fissile materials and radioactive isotopes that are non-fissile, but produce radiation—either alpha, beta or gamma type radiation;

(b) the term "fissile material" includes uranium, plutonium, thorium, neptunium and mixtures of plutonium and uranium;

(c) Uranium refers to the following classifications—depleted uranium (U-235 concentration less than 0.7%), natural uranium (U-235 concentration equal to approximately 0.7%), low enriched uranium (U-235 or U-233 concentration less than 20%), high enriched uranium (U-235 or U-233 greater than 20%);

(d) Plutonium refers to reactor grade plutonium where the Pu-240 concentration is nominally 10% to 15%.

The best-known method of generating electrical power using nuclear energy is via heat exchange processes, the method used in nuclear power plants to generate electricity for use in the United States national grid. In the nuclear power plant, rods of uranium-235 are positioned in a reactor core where fission, the splitting of the uranium-235 atoms, occurs. When the uranium-235 atom splits apart, large amounts of energy are emitted. Inside the nuclear power plant, the rods of uranium are arranged in a periodic array and submerged in water inside a pressure vessel. The large amount of energy given off by the fission of the uranium-235 atoms heats the water and turns it to steam. The steam is used to drive a steam turbine, which spins a generator to produce electrical power.

In some reactors, the superheated water from the reactor goes through a secondary, intermediate heat exchanger to convert water to steam in the secondary loop, which drives the turbine. Apart from the fact that the energy source is uranium-235, the nuclear power plant uses the same power conversion methods found in power plants that burn fossil fuels.

Nuclear power plants, in general, have energy conversion rates of between 30 and 40 percent. This efficiency rate is very good considering that several steps are used in such power plants to convert the nuclear energy to electrical energy. Consequently, nuclear power plants are a good source for large-scale generation of electricity. However, apparatus that use heat transfer techniques for generating electricity from nuclear energy are, in general, large and inefficient for small-scale power conversion.

Research has been performed into ways of reducing the size of the equipment necessary for an effective heat transfer system for generating electrical power from nuclear materials. Some success has been achieved, and since the 1950s small nuclear power plants have powered a great number of military submarines and surface ships. However, because of the associated risks, heat transfer systems have not been used for other small-scale energy sources and are no longer used on United States space vehicles. The use of nuclear energy to power nuclear submarines highlights the advantages that nuclear materials have as a power source; for example, a nuclear submarine can travel 400,000 miles before needing to be refueled.

Because of the potential of nuclear materials as a source for providing energy over a long period of time, a great deal of research has been performed to develop a small, self-contained power source utilizing nuclear materials that does not have the associated risks inherent in a heat transfer system. This research has led to the development of several methods of converting nuclear energy into electrical energy.

Theoretically, the best methods for converting nuclear energy into electrical energy should be direct methods where the nuclear energy is directly changed into electrical energy. The nuclear power plant discussed above involves an indirect, two-step process in which the nuclear energy is transferred into thermal energy that causes water to turn to steam that is used to drive turbines and create electrical energy. Direct conversion methods are potentially the most efficient conversion methods because they would avoid the inherent energy loss during each conversion process. The following are examples of direct conversion techniques that have been proposed up until the present date.

Conversion of nuclear energy to electrical energy using solid semiconductors. In this process, radiation energy from the radioactive isotope is directly converted to electrical energy by irradiating a semiconductor material with radioactive decay products to produce a number of electron-hole pairs in the material. To accomplish this, nuclear material, such as a radioactive isotope, is placed in close proximity to a solid semiconductor. As it decays, the radioactive isotope produces radiation. Because it is in close proximity with the solid semiconductor, some of this radiation enters the solid semiconductor and causes electron-hole pairs to be generated. Generally, the solid semiconductor is configured so as to incorporate a p-n junction that contains a built-in electric field within a region called the depletion region. This electrical field applies a force that drives electrons and holes generated in the depletion region in opposite directions. This causes electrons to drift toward the p type neutral region and holes toward the n type neutral region. As a result, when radiation enters the solid semiconductor, an electrical current is produced. Current can also be generated from electron-hole pairs produced within a few diffusion lengths of the depletion region by a mechanism involving both diffusion and drift. A Schottky barrier junction formed on either an n-type or p-type semiconductor can also be used in lieu of the p-n junction. In that case, an analogous process occurs when the metal on the n-type (p-type) semiconductor collects drifting holes, as did the p-type (n-type) neutral region in the p-n junction.

The potential conversion efficiency of the solid semiconductor system is high. However, the solid semiconductor method of converting nuclear power cannot be used to produce large power outputs for extended periods of time because the high energy radiation that enters the solid semiconductor also causes damage to the semiconductor lattice. Furthermore, if the energy source is fissile material, some of the fragments of fissile material that enter the solid semiconductor remain in the solid semiconductor. The introduction of trace amounts of defects, including native and impurity point defects and extended defects, can significantly reduce semiconductor device performance. Over time the solid semiconductor is degraded and efficiency decreases until it is no longer useful for power conversion. Consequently, even though systems using solid semiconductors as direct converters of nuclear energy to electrical energy are potentially very efficient, they are often impractical for high power, long duration applications.

Conversion of nuclear energy to electrical energy using Compton scattering. Compton scattering occurs when high-energy gamma radiation interacts with matter causing electrons to be ejected from the matter. A method for direct conversion of nuclear energy to electrical energy has been proposed in which a gamma radiation source is surrounded by an insulating material. As a result of Compton scattering, the gamma rays interact with the insulating material and cause electrons to be produced. These electrons can be collected to produce an electric current. Experiments to date have not been able to demonstrate that this method can generate sufficiently large amounts of electricity with the required efficiency and reliability at a sufficiently low cost to be useful for widespread use in practical applications.

Conversion of nuclear energy to electrical energy using an induction process. The use of induction to convert nuclear energy to electrical energy involves apparatus that provides electrical power by modulating the density of a cloud of charged particles confined within an enclosed space by a magnetic field. A radioactive material is positioned at the center of an enclosing hollow sphere having its inner surface coated with a metal, such as silver. The sphere is centrally positioned between the poles of a permanent magnet. As the radioactive material decays it emits radiation that in turn causes the cloud of charged particles to move. The movement of the charged particles results in a variation in the density of the cloud of charged particles and a variation in the magnetic field created by the cloud. This variation in the magnetic field induces an electric current in a conductive wire. Once again, the conversion efficiency of the system is very low and the amount of electrical power provided is too small for most applications.

Conversion of nuclear energy to electrical energy using thermoelectric systems. Thermoelectric conversion systems rely on direct conversion of thermal energy to electricity by means of the Seebeck effect. The Seebeck effect describes the phenomenon that when a thermal gradient occurs in a system containing two adjacent dissimilar materials, a voltage can be generated. Therefore, if radioactive material is placed in proximity to the system, the radiation produced by the radioactive material will heat the material causing a thermal gradient and as a result of the Seebeck effect, a voltage difference can be generated. A load can be inserted into the system, allowing electrical power to be removed from the system. Thermoelectric converters are used in radioisotope thermoelectric generators for deep space probes and can provide up to a kilowatt of power. However, theoretical conversion efficiencies for commonly used materials are only 15-20 percent and in practice, conversion efficiencies are much lower.

Conversion of nuclear energy to electrical energy using thermionic systems. Thermionic systems make use of the physical principle that certain materials when heated will emit electrons. Thermionic systems use nuclear matter, radioisotopes or fissile material, as an energy source to heat an emitter cathode that emits electrons which can be collected on an anode surface, delivering electrical power to an external load. Conversion efficiencies for thermionic systems increase with emitter temperature, with theoretical efficiencies ranging from 5% at 900 K to over 18% at 1,750 K. The drawbacks of the thermionic conversion system are poor efficiencies, high operating temperatures, and intense radiation environments.

Conversion of nuclear energy to electrical energy using fluorescent materials. In this system, a mixture of a radioactive substance and a fluorescent material is positioned between a pair of photovoltaic cells. The radioactive substance produces radioactive rays that excite the atoms of the fluorescent material and cause it to emit photons. The photovoltaic cells use this radiation to generate electricity. In general, this system requires a very complex structure but nevertheless provides poor conversion efficiency on the order of less than 0.01%.

SUMMARY OF THE INVENTION

As described above, ever since nuclear power was recognized as a viable energy source in the 1950s, considerable research has been performed to find better methods for converting nuclear power into electrical power. However, no direct conversion method has been created that is efficient and practical. In view of the foregoing, an objective of the present invention is to improve upon the prior art by providing a method and apparatus for the efficient, direct conversion of nuclear energy, either radioactive decay energy or fission energy, into electrical energy. More specifically, it is an object of the present invention to provide a self-contained method and apparatus for converting nuclear power to electrical power that can generate large amounts of electrical power for long periods of time without the need for frequent refueling and require little or no maintenance. Another object of the present invention is to provide a method and apparatus that meets the long felt need for a method of converting nuclear energy to electrical energy that is small in size, reliable and can generate large amounts of electrical energy for use in submarines, surface ships, and as a battery to power a whole range of products—including, for example, military equipment, satellites and space vehicles.

Each embodiment of the current invention relates to the use of a liquid semiconductor in conjunction with a radiation source: either fissile material such as uranium-235 or plutonium, or a radioactive isotope. Use of a liquid semiconductor minimizes the effects of radiation damage, because liquid semiconductors rapidly self-heal, and can be purified or "scrubbed" of fission fragments left from fission events. The current invention comprises different embodiments, several of which are described below.

Embodiments Utilizing Fissile Materials

Embodiment 1: A nuclear voltaic cell with fissile material applied in a solid layer, and the layers of the nuclear voltaic cell axially opposed to each other and wound around a mandrel.

Embodiment 2: A nuclear voltaic cell with fissile material applied in a solid layer, and the layers of the nuclear voltaic cell axially opposed to each other and stacked on top of each other.

Embodiment 3: A nuclear voltaic cell with fissile material in solution in a liquid semiconductor, and the layers of the nuclear voltaic cell axially opposed and wound around a mandrel.

Embodiment 4: A nuclear voltaic cell with fissile material in solution in a liquid semiconductor, and the layers of the nuclear voltaic cell axially opposed to each other and stacked on top of each other.

Embodiment 5: An array of nuclear voltaic cells according to Embodiments 1, 2, 3, or 4.

Embodiment 6: A nuclear voltaic cell reactor core, with one closed loop in two sections for quiet continuous removal of waste heat. One liquid semiconductor is used for both energy conversion and cooling. The heat extractor on one section is also used for scrubbing the liquid semiconductor of unwanted fission fragments, while the opposing heat extractor may be used for replacing burned-up fissile material (if necessary).

Embodiment 7: A nuclear voltaic cell reactor core with separate loops, one for fission fragment scrubbing, one for cooling. Liquid semiconductor used for energy conversion, another substance (inert gas, water, etc.) used for cooling.

Embodiments Utilizing Radioactive Isotopes:

Embodiment 8: A nuclear voltaic cell with a radioactive isotope in solution with the liquid semiconductor, and the layers of the nuclear voltaic cell axially opposed to each other and wound around a mandrel.

Embodiment 9: A nuclear voltaic cell with a radioactive isotope in solution with the liquid semiconductor, and the layers of the nuclear voltaic cell axially opposed to each other and stacked on top of each other.

Embodiment 10: An array of nuclear voltaic cells according to Embodiments 8 or 9.

In accordance with one embodiment of the invention, there is provided a compact cell for supplying large amounts of electrical energy for a long duration. The cell includes nuclear material for providing nuclear energy, either radiation or fission energy.

In embodiment 1, a solid layer of the nuclear material is placed in close proximity to a liquid semiconductor. Nuclear energy in the form of fission fragments enters the liquid semiconductor and creates electron-hole pairs. The liquid semiconductor is an n-type or p-type semiconductor that is sandwiched between two metal contacts that are selected so as to create a Schottky diode when placed in contact with the n-type or p-type liquid semiconductor. The structure contains both a Schottky contact and a low resistance or an Ohmic contact. As a consequence of this Schottky diode arrangement, a potential difference is produced across the liquid semiconductor that causes the electron-hole pairs, created by interactions with the nuclear radiation or energetic particles, to migrate to the metallic contacts. By placing an electrical load on the contacts of the present invention electrical power is generated. In a preferred embodiment, the nuclear voltaic cell comprising of nuclear material and a liquid semiconductor is constructed by wrapping the layers of materials around a mandrel in a spiral fashion.

In embodiment 2, a solid layer of the nuclear material is placed in close proximity to a liquid semiconductor. As in embodiment 1, nuclear energy in the form of fission fragments enters the liquid semiconductor and creates electron-hole pairs. The liquid semiconductor is an n-type or p-type semiconductor that is sandwiched between two metal contacts that are selected so as to create a Schottky diode and a low resistance or Ohmic contact when placed in contact with the n-type or p-type liquid semiconductor. As a consequence of this Schottky diode arrangement, a built-in field is produced in the depletion region within the liquid semiconductor that causes electron-hole pairs to drift in different directions. By exposing the material to radiation and placing an electrical load on the contacts of the present invention, electrical power is generated. In a preferred embodiment of embodiment 2, a nuclear voltaic cell is constructed by stacking the layers of materials.

In a preferred embodiment of the current invention, described as embodiment 3 above, nuclear material providing fission energy is dissolved in the liquid semiconductor. Again, nuclear energy in the form of fission fragments is released within the liquid semiconductor that generates electron-hole pairs. The liquid semiconductor is an n-type or p-type semiconductor that is sandwiched between two metal contacts that are selected so as to create a Schottky diode and a low resistance or Ohmic contact when placed in contact with the n-type or p-type liquid semiconductor. A built-in field is produced within the depletion region of the liquid semiconductor that causes electrons and holes generated either in the depletion width or within a few diffusion lengths of it to move in opposite directions. This results in the generation of a current. By placing an electrical load on the contacts of the present invention, electrical power is generated. In a preferred embodiment, a nuclear voltaic cell is constructed by wrapping the layers of materials around a mandrel in a spiral fashion.

In Embodiment 4, nuclear material providing fission energy is dissolved in the liquid semiconductor. Nuclear energy in the form of energetic fission fragments interacts with the liquid semiconductor and creates electron-hole pairs. The liquid semiconductor is an n-type or p-type semiconductor that is sandwiched between two metal contacts that are selected so as to create a Schottky diode and a low resistance or Ohmic contact when placed in contact with the n-type or p-type liquid semiconductor. A built-in field is produced within the depletion region of the liquid semiconductor that causes electrons and holes generated either in the depletion width or within a few diffusion lengths of it to move in opposite directions. This results in the generation of a current. By placing an electrical load on the contacts of the present invention electrical power is generated. In a preferred embodiment, a nuclear voltaic cell is constructed by stacking the layers of materials.

Unlike previous methods for converting nuclear energy to electrical energy using solid semiconductors, the present invention can use fission or high-energy radiation to generate large amounts of electrical power without rapid deterioration of the collection efficiency. This is because, unlike the lattice of a solid semiconductor, the short-range order of a liquid semiconductor is not permanently degraded by the interaction with fission fragments or high-energy radiation. Therefore, in a preferred embodiment of the present invention, the liquid semiconductor is made to flow through the active region of the nuclear voltaic cell (something that is not possible with solid semiconductors), and is purified or scrubbed of unwanted fission fragments and neutron activation products so that its purity and semiconductive properties are not degraded over time, making the conversion device capable of continuous optimum energy conversion. In addition, burned-up fissile material may be replaced while the reactor is operating, avoiding down time for refueling. Because of these advantages, the present invention provides for efficient conversion and the generation of large amounts of electrical power, features that are not possible with solid semiconductor devices.

The present invention is very adaptable because multiple nuclear voltaic cells—comprising any of the embodiments described above, i.e., embodiments 1, 2, 3, or 4—may be linked together to form a critical array, described as embodiment 5 above, to provide power up to and exceeding the megawatt range. For small power needs a single or small number of cells may be used. In a preferred embodiment of the present invention, described as embodiment 6 above, the array thus formed constitutes a nuclear voltaic reactor core surrounded by appropriate shielding and cooling materials. In a preferred embodiment, the nuclear voltaic reactor core uses the same liquid semiconductor employed in energy conversion for cooling. In a preferred embodiment, the coolant loop is divided into two sections, each with a heat extractor. The loop sections are separated by oscillating valves and an oscillating pneumatic piston and chilled coolant from one heat extractor is quietly forced by high inert gas pressure through the core, while coolant warmed by waste heat in the core flows into the other heat extractor at low inert gas pressure. When the first heat extractor is empty and the second extractor is filled, the oscillating valves change positions and the piston reverses direction to provide continuous quiet cooling of the core. One heat extractor also is used to scrub unwanted fission fragments and neutron activation products while the other may be used to replace burned-up fissile material.

In a preferred embodiment of the current invention, the nuclear voltaic reactor core, described in Embodiment 7 above, has two separate loops, one for energy conversion and fission fragment/activation product scrubbing and the other for cooling, but the coolant can be something other than a liquid semiconductor. In this way, the present invention is adaptable and can meet many different needs, including generating power for the electricity grid and providing electrical energy for a wide range of such diverse applications including space vehicles, submarines and military equipment.

In another preferred embodiment, the present invention may also be used to construct a nuclear voltaic battery. In Embodiment 8, described above, the nuclear material in the form of a radioactive isotope is dissolved in a liquid semiconductor. Dissolving the radioactive isotope in the liquid semiconductor is a preferred embodiment of the invention, however, in another embodiment the radioactive isotope may instead be positioned in close proximity to the liquid semiconductor. Nuclear energy in the form of alpha, beta, and/or gamma radiation enters the liquid semiconductor and creates electron-hole pairs. The liquid semiconductor is an n-type or p-type semiconductor that is sandwiched between two metal contacts that are selected so as to create a Schottky diode and a low resistance or Ohmic contact when placed in contact with the n-type or p-type liquid semiconductor. A built-in field is produced within the depletion region of the liquid semiconductor that causes electrons and holes generated either in the depletion width or within a few diffusion lengths of it to move in opposite directions. This results in the generation of a current. By placing a load on the contacts of the present invention electrical power is generated. In a preferred embodiment, the nuclear voltaic cell is constructed by wrapping the layers of materials around a mandrel in a spiral fashion.

In Embodiment 9, described above, the nuclear material in the form of a radioactive isotope is dissolved in a liquid semiconductor. As in Embodiment 8, nuclear energy in the form of alpha, beta, and/or gamma radiation enters the liquid semiconductor and creates electron-hole pairs. The liquid semiconductor is an n-type or p-type semiconductor that is sandwiched between two metal contacts that are selected so as to create a Schottky diode and a low resistance or Ohmic contact when placed in contact with the n-type or p-type liquid semiconductor. A built-in field is produced within the depletion region of the liquid semiconductor that causes electrons and holes generated either in the depletion width or within a few diffusion lengths of it to move in opposite directions. This results in the generation of a current. By placing an electrical load on the contacts of the present invention electrical power is generated. In a preferred embodiment, a nuclear voltaic cell is constructed by stacking the layers of material.

In a preferred embodiment of the of the present invention, the liquid semiconductor is made to flow through the active region of the nuclear voltaic cell (something that is not possible with solid semiconductors), and is purified or scrubbed of unwanted decay products so that its semiconductive properties are not impaired over time, making the conversion device capable of continuous optimum energy conversion. Because of these advantages, the present invention provides for efficient conversion and the generation of large amounts of electrical power for long periods of time, things that were not possible with solid semiconductors.

The present invention is very adaptable because multiple nuclear voltaic cells may be linked together in an array to form a nuclear voltaic battery, described in Embodiment 10 above, to provide power ranges from fractions of a watt to greater than Megawatts. For small power needs a single or small number of cells may be used.

DETAILED DESCRIPTION OF THE INVENTION

Figure 1:
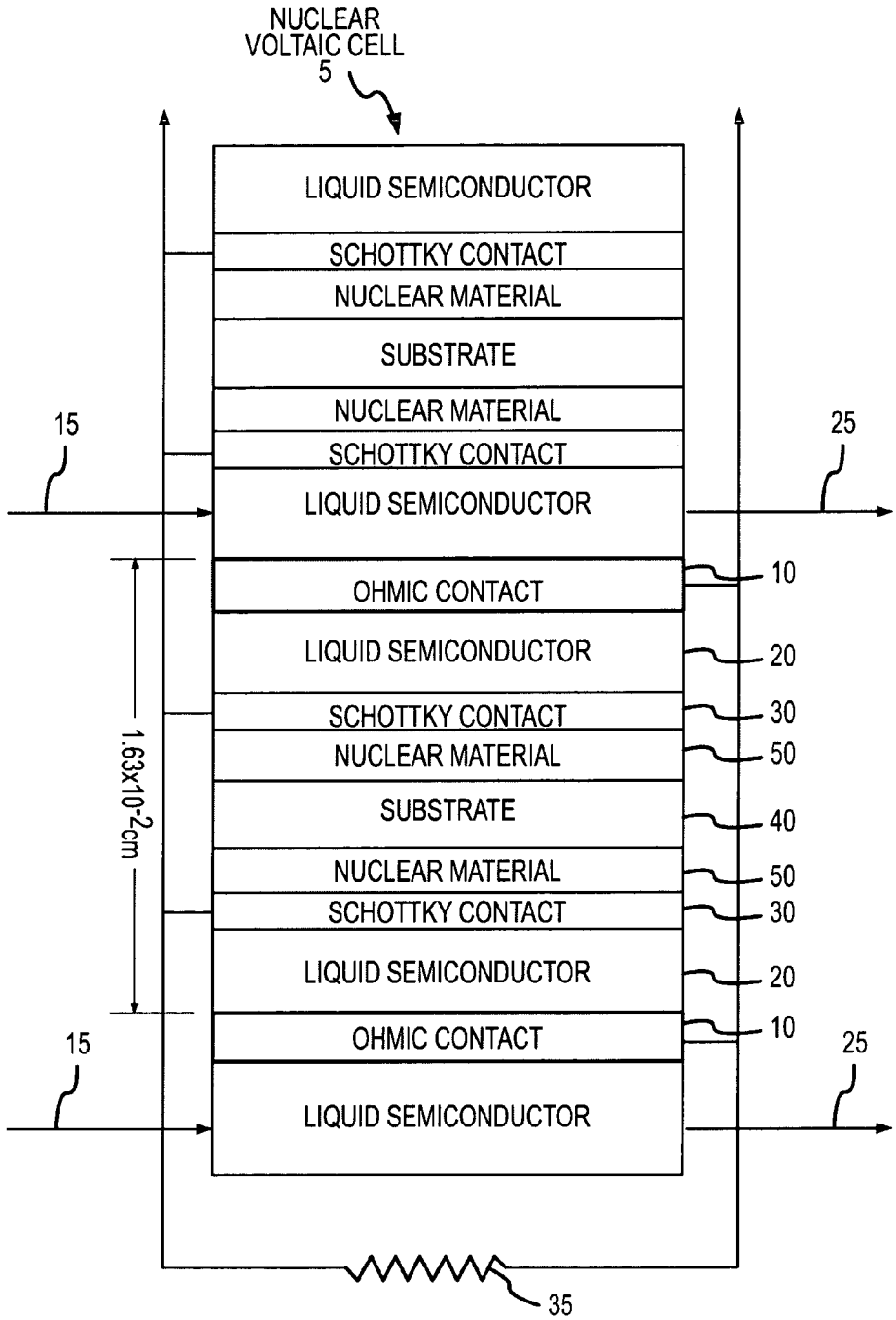
FIG. 1 shows a schematic cross section through one embodiment of the nuclear voltaic cell, wherein the nuclear material is coated on a substrate.

FIG. 1 shows a cross section through one embodiment of the Nuclear Voltaic Cell 5. In this embodiment, the Liquid Semiconductor 20 is sandwiched between two metal contacts; the Ohmic Contact 10 and the Schottky Contact 30. The device will also function if a low resistance contact is used in lieu of the Ohmic Contact 10. This may be necessary in the case that an ideal Ohmic Contact 10 is not readily available as a result of fundamental or practical reasons.

As shown in FIG. 1, the Liquid Semiconductor 20 is sandwiched between the two metal contacts, the Ohmic Contact 10 and the Schottky Contact 30. Furthermore, as shown in FIG. 1, the two metal contacts, the Ohmic Contact 10 and the Schottky Contact 30, form a channel through which the Liquid Semiconductor 20 may flow. In a preferred embodiment of the present invention, the Liquid Semiconductor 20 flows in the direction of the Arrow 15 into the channel between the Ohmic Contact 10 and the Schottky Contact 30 and then flows out of the channel between the Ohmic Contact 10 and the Schottky Contact 30 in the direction of the Arrow 25. In a preferred embodiment of the present invention, the two ends of the channel between the Ohmic Contact 10 and the Schottky Contact 30 are connected by a closed loop and a pump is used to to circulate the Liquid Semiconductor 20 through the channel between the Ohmic Contact 10 and the Schottky Contact 30 and around the closed loop.

As persons familiar with the art will understand, the Ohmic Contact 10 is preferably made from a metal such that no, or a minimal barrier, exists between the Ohmic Contact 10 and the Liquid Semiconductor 20. Furthermore, as persons familiar with the art will understand, the Schottky Contact 30 is preferably made from a metal such that when placed in contact with the Liquid Semiconductor 20 a substantial electrostatic barrier is created across the Liquid Semiconductor 20. In the embodiment of the present invention described in FIG. 1, a Substrate 40 is plated with Nuclear Material 50 and the metal Schottky Contact 30 is coated on top of the Nuclear Material 50. In a preferred embodiment of the invention, the Ohmic Contact 10 and the Schottky Contact 30 are connected in a circuit so that a Load 35 may be applied to the circuit and electrical energy removed from the present invention.

As shown in FIG. 1, in a preferred embodiment of the present invention, the cross section of the strata making up the active parts of the invention is of the order of $1.63\times10^{-2}$ cm across. In a preferred embodiment, non-active spacers are placed between the Ohmic Contact 10 and the Schottky Contact 30 to maintain the separation of the two contacts. In an alternative embodiment, the Nuclear Material 50 may be replaced with a non-fissile radioactive isotope that produces either of or a combination of alpha, beta or gamma radiation as it decays.

In a preferred embodiment of the invention, the Liquid Semiconductor 20 is a solid at room temperature and is deposited between the Ohmic Contact 10 and the Schottky Contact 30. In a preferred embodiment of the present invention, the layers of the Nuclear Voltaic Cell 5 are fabricated using thin film technology. In a preferred embodiment of the invention, once the layers of the Nuclear Voltaic Cell 5 have been fabricated, the Nuclear Voltaic Cell 5 is heated so as to melt the Liquid Semiconductor 20. Optimum operating temperatures will vary depending upon the properties of the Liquid Semiconductor 20 used. In a preferred embodiment, the Liquid Semiconductor is selenium and the operating temperature is 230-250° Celsius. It will be understood by those experienced in the art that liquid semiconductors other than selenium may be employed. Over particular ranges of temperature and composition, liquid semiconductors may be formulated from pure chalcogens (oxygen, sulfur, selenium and tellurium). Among other possibilities, suitable liquid semiconductors include mixtures of chalcogens, and alloys of chalcogens with metals. In a preferred embodiment of the present invention, after initial heating by an external source, the heat generated from the nuclear material maintains the temperature of the Nuclear Voltaic Cell 5.

In a preferred embodiment of the present invention, an external electrical power source is used to heat the Nuclear Voltaic Cell 5 and liquefy the semiconductor. In an alternative embodiment, the Liquid Semiconductor 20 is liquid at room temperature and the present invention does not have to be heated prior to operation.

Figure 2:
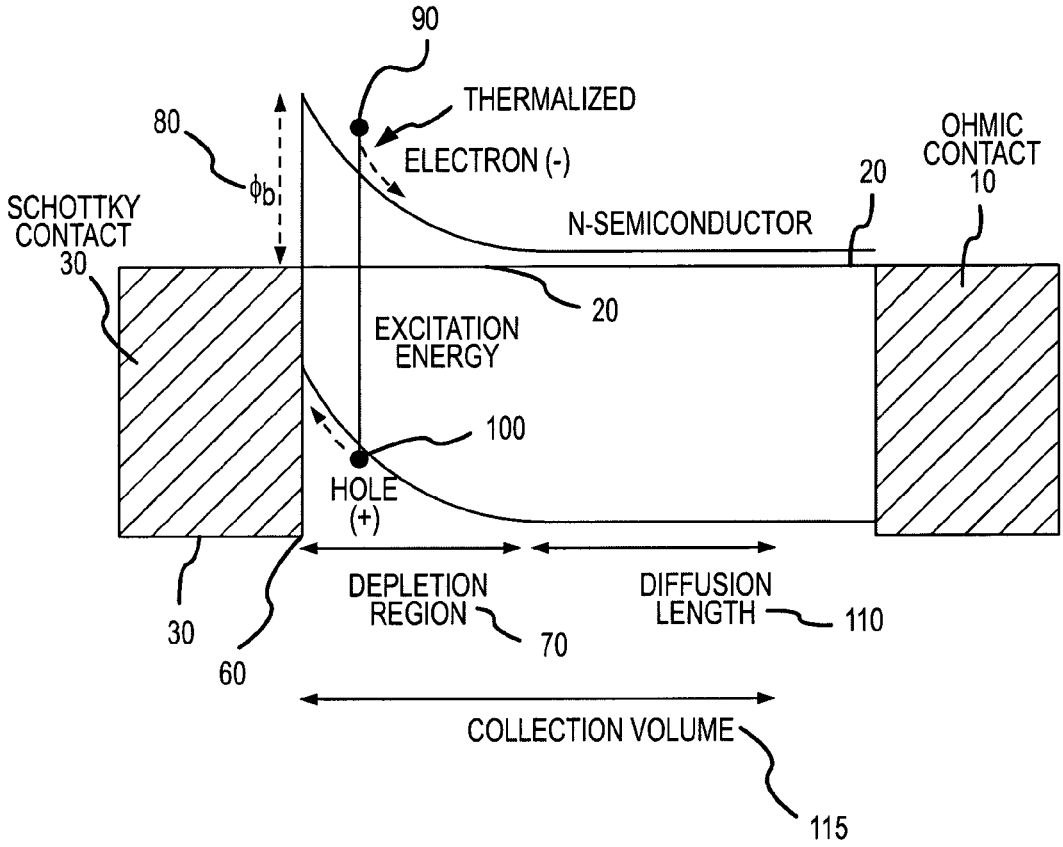
FIG. 2 shows a potential energy diagram for the junction between the Schottky contact and an n-type liquid semiconductor.

FIG. 2 shows an energy band diagram for the Junction 60 between the Schottky Contact 30 and the Liquid Semiconductor 20. The metal of the Schottky Contact 30 is chosen so that at equilibrium a potential difference is created across the Liquid Semiconductor 20. In a preferred embodiment of the present invention, the Liquid Semiconductor 20 is an n-type semiconductor. The point of contact between the Schottky Contact 30 and the Liquid Semiconductor 20 is often referred to in the art as a junction.

At thermal equilibrium, with no external voltage applied, there is a region in the Liquid Semiconductor 20 close to the Junction 60, which is depleted of mobile carriers. This is known in the art as the Depletion Region 70. The height of the barrier in the Liquid Semiconductor 20 from the Fermi level to the top of the electrostatic barrier is equal to the Built-In Potential $\phi_b$ 80. Electrons 90 or Holes 100 that enter the Depletion Region 70 will experience a force between the neutral part of the Liquid Semiconductor 20 and the metal of the Schottky Contact 30 because of the electric field resulting from the Potential Barrier 80 in the Liquid Semiconductor 20. The Diffusion Length 110 depends upon the properties of the Liquid Semiconductor 20 used and is a measure of how far excess Electrons 90 or Holes 100 on average can diffuse in the Liquid Semiconductor 20 before recombining. The Collection Volume 115 is a combination of the Depletion Region 70 and a multiple of the Diffusion Length 110 and represents the volume in which Electrons 90 and Holes 100 are collected. These carriers, Electrons 90 and Holes 100, initiate the generation process that results in current flowing through the Liquid Semiconductor 20.

As persons familiar with the art will understand, while the potential energy diagrams will be different if a p-type liquid semiconductor is used, the same overall result, the flow of Electrons 90 and Holes 100 and creation of an electrical current may be produced by either the use of an n-type or a p-type liquid semiconductor.

In a preferred embodiment of the invention, the Liquid Semiconductor 20 is liquid selenium at a temperature above 233° Celsius. Liquid selenium is a preferred Liquid Semiconductor 20 because it has a very large band-gap, which produces a large Potential Barrier 80 across the Depletion Region 70, and a large Diffusion Length 110. However, other liquid semiconductors may be used which improve on the characteristics of selenium.

Figure 3:
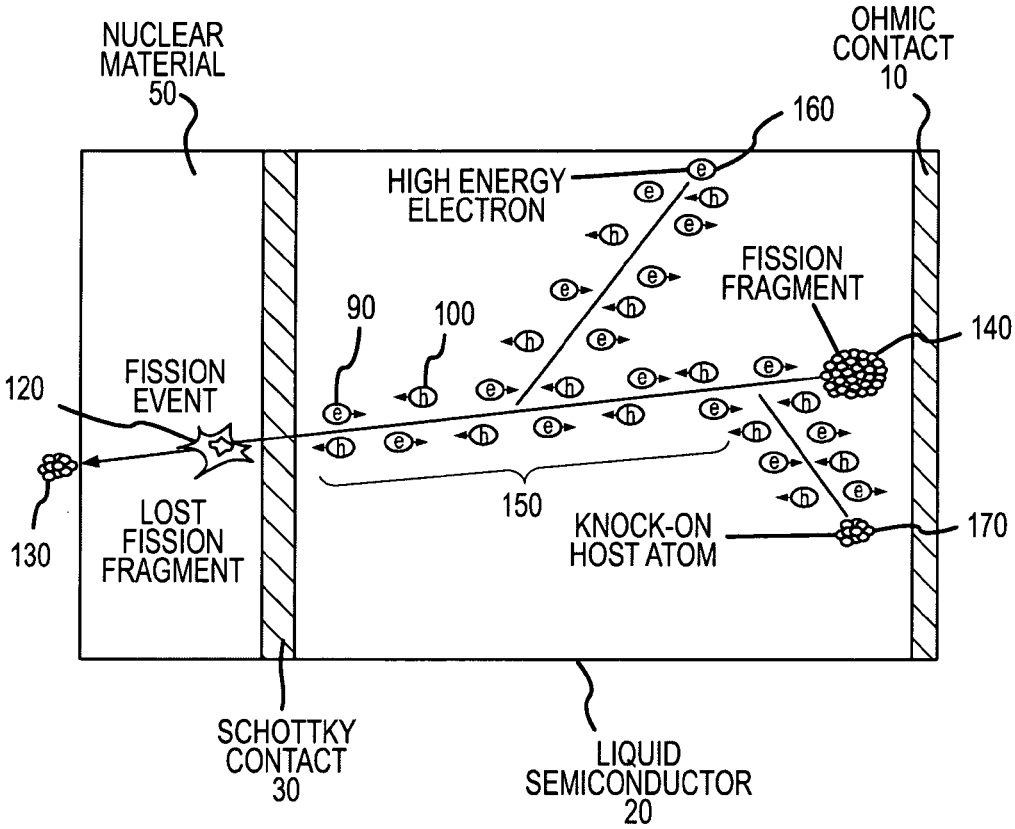
FIG. 3 shows a fission event occurring in the nuclear voltaic cell.

FIG. 3 shows a cross section of the present invention when a Fission Event 120 occurs. In a preferred embodiment of the invention, the Nuclear Material 50 is Uranium-235. A Fission Event 120 occurs when the atom of the Nuclear Material 50 splits. As persons familiar with the art will understand, a Fission Event 120 may occur naturally or, more likely, as a result of an impact with a neutron ejected during another fission event. As a result of the Fission Event 120, two fragments of the Nuclear Material 50 are created. In the embodiment of the present invention shown in FIG. 3, one fragment of the Nuclear Material 50, the Lost Fission Fragment 130, does not enter the Liquid Semiconductor 20. The other Fission Fragment 140, however, enters the Liquid Semiconductor 20. As persons familiar with the art will understand, the Fission Fragment 140 is highly energetic. For example in the case of Uranium-235, the average energy of Fission Fragment 140 is between 67 and 95 MeV. When the Fission Fragment 140 enters the Liquid Semiconductor 20 it interacts with the atoms and electrons of the Liquid Semiconductor 20 and creates Electron-Hole Pairs 150 along a track in the Liquid Semiconductor 20. This process creates large quantities of Electrons 90 and Holes 100 in the Liquid Semiconductor 20. The Fission Fragment 140 may also interact with the atoms and electrons of the Liquid Semiconductor 20. Such interaction can cause the creation of a High Energy Electron 160 and Knock-On Host Atom 170. The High Energy Electron 160 and the Knock-On Atom 170 may also result in the creation of more Electrons 90 and Holes 100. Because of the Potential Barrier 80 between the low resistance or Ohmic Contact 10 and the Schottky Contact 30, the Electrons 90 and the Holes 100 move in opposite directions and result in the flow of electric current between the Ohmic Contact 10 and the Schottky Contact 30. As shown in FIG. 2, the Potential Barrier 80 exists across the Depletion Region 70. As a result, only Electrons 90 or Holes 100 that are in the Depletion Region 70 or diffuse into the Depletion Region 70 will become part of the flow of Electrons 90 and Holes 100 between the Ohmic Contact 10 and the Schottky Contact 30. As discussed above, liquid selenium is a preferred liquid semiconductor because it has a large Diffusion Length 110 associated with it and consequently provides for the capture of more Electrons 90 and Holes 100.

The Nuclear Material 50 not only produces Fission Fragments 140 when its atom is split, but also produces secondary radiation that will ionize the atoms of the Liquid Semiconductor 20 producing Electrons 90 and Holes 100 that will result in electrical energy generation. In an alternative embodiment of the present invention, the Nuclear Material 50 may be a non-fissile radioactive isotope that produces either of or a combination of alpha, beta or gamma radiation as it decays. In such an embodiment of the present invention, the alpha, beta or gamma rays when they enter the Liquid Semiconductor 20 will produce Electrons 90 and Holes 100. As such, the operation of the present invention is the same as when Nuclear Material 50 is used except, however, the alpha, beta or gamma rays do not produce as many Electrons 90 and Holes 100 per incident radiation and, as a consequence, an embodiment of the present invention using a non-fissile radioactive isotope may not be able to generate as much electrical power as an embodiment using Nuclear Material 50.

In one embodiment of the present invention, non-fissile radioactive isotopes may be used to provide lower power outputs with less associated radiation. This type of power source is more practical for use in devices that are in close proximity to a human operator because a lightweight radioactive shield can be placed around the device. Such a power source is well suited for use in space vehicles and military equipment where high power outputs are not required and a smaller device that is not highly radioactive is necessary.

Figure 4:
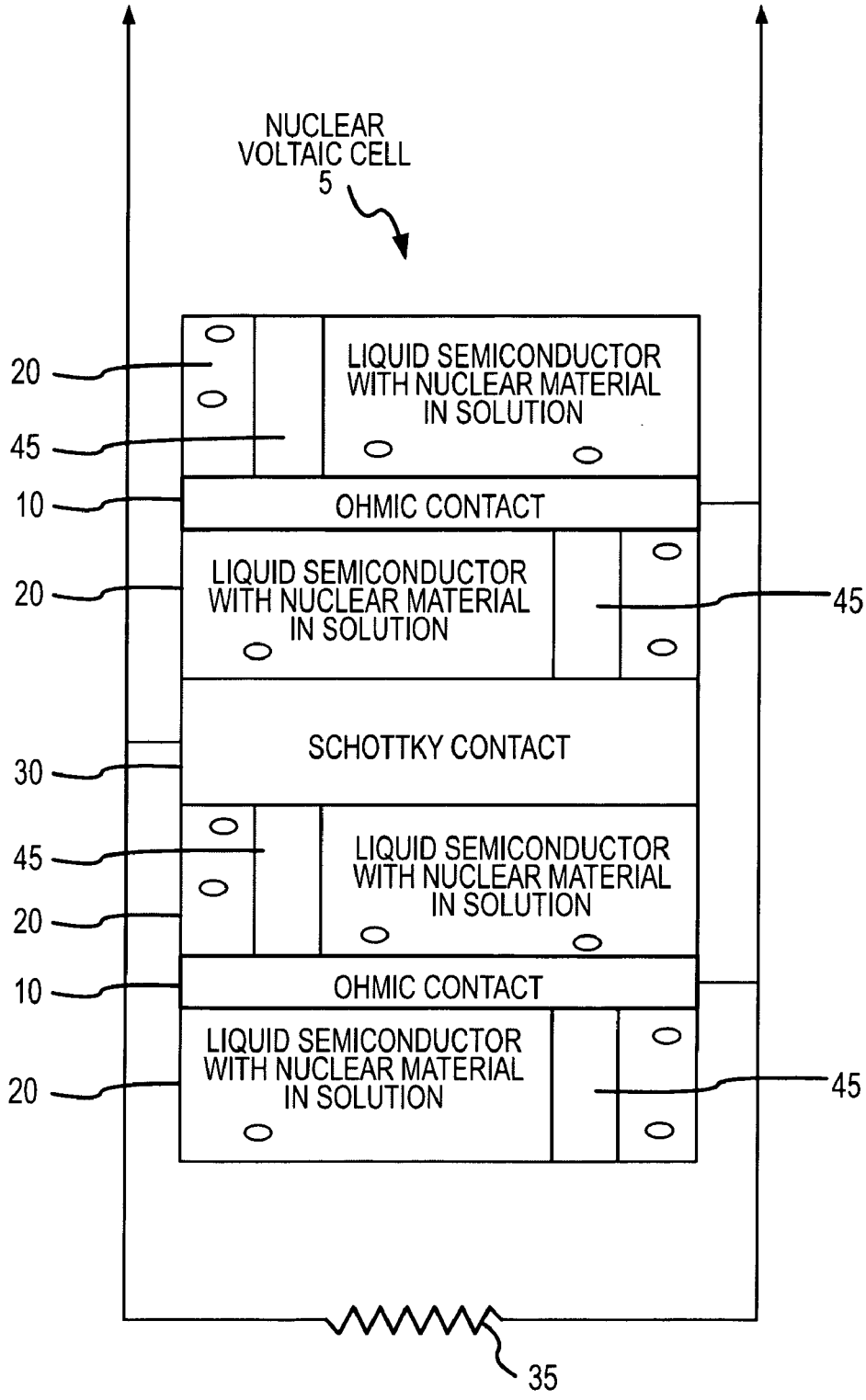
FIG. 4 shows a schematic cross section of a preferred embodiment of the present invention wherein the nuclear material is in solution in the liquid semiconductor.

FIG. 4 shows a cross section of a preferred embodiment of the present invention wherein the Nuclear Material 50 is in solution in the Liquid Semiconductor 20. In this preferred embodiment, the Liquid Semiconductor 20 is sandwiched between the low resistance or Ohmic Contact 10 and the Schottky Contact 30 and the Nuclear Material 50 is in solution in the Liquid Semiconductor 20. Nonconductive Spacers 45 are placed in abutment between the Ohmic Contact 10 and the Schottky Contact 30 to maintain the channel between the two contacts so that they do not touch each other. This is a preferred embodiment of the invention because when a Fission Event 120 occurs there are no lost fission fragments and both fission fragments will travel through the Liquid Semiconductor 20 and either fission fragment may cause generation of electron-hole pairs within the Liquid Semiconductor 20. As a consequence, this preferred embodiment is more efficient than the embodiment described in FIG. 3.

Figure 5:
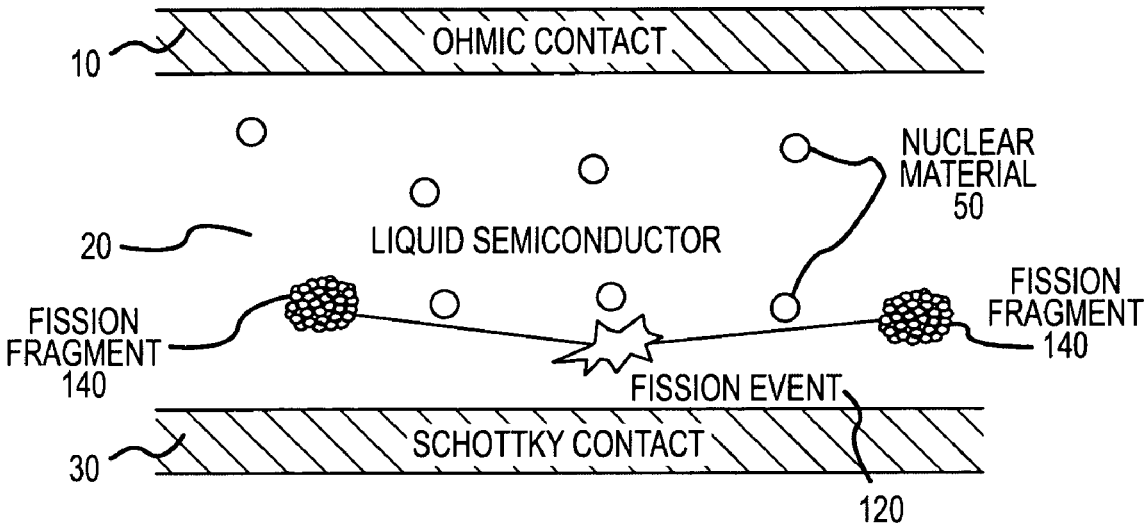
FIG. 5 shows a fission event occurring from fissile material dissolved in the liquid semiconductor in the nuclear voltaic cell in one embodiment of the present invention.

FIG. 5 shows a Fission Event 120 occurring within the Liquid Semiconductor 20, and illustrates that in the embodiment wherein the Nuclear Material 50 is in solution in the Liquid Semiconductor 20, both Fission Fragments 140 are available to generate electron-hole pairs in the Liquid Semiconductor 20.

Figure 6:
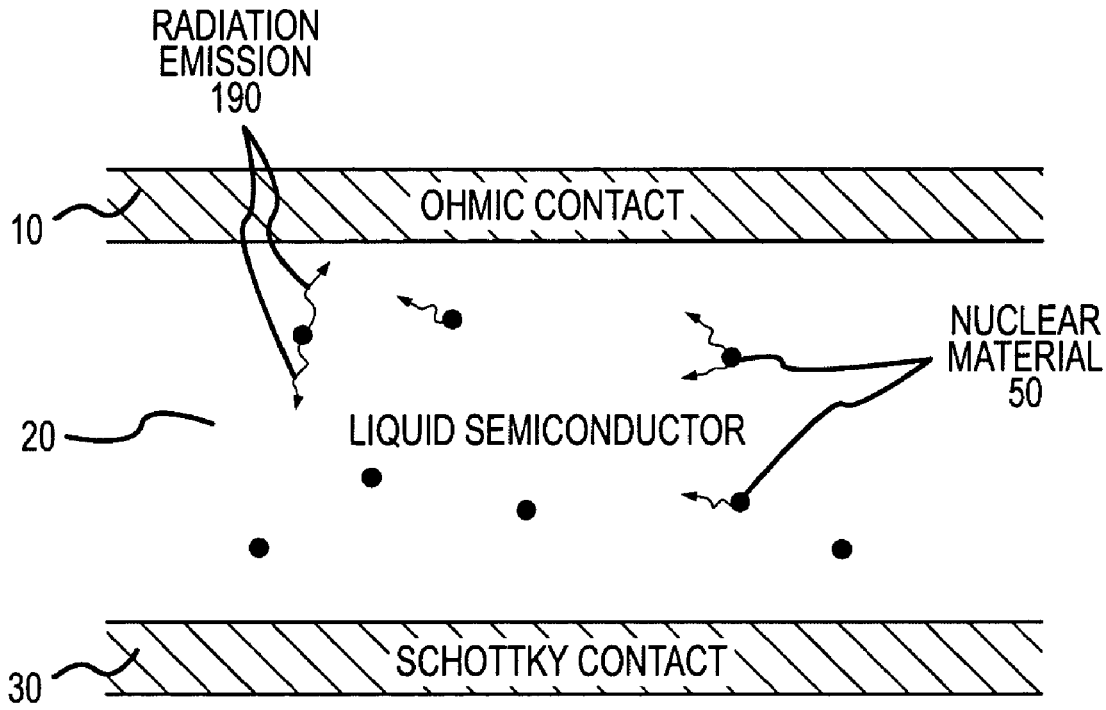
FIG. 6 shows the emission of alpha, beta, or gamma rays from a radioactive isotope dissolved in the liquid semiconductor in the nuclear voltaic cell in one embodiment of the present invention.

FIG. 6 shows an alternative embodiment of the present invention where the Nuclear Material 50 is a non-fissile radioactive isotope. In a preferred embodiment, the non-fissile material would be in solution in the Liquid Semiconductor 20 so that Radiation Emission 190 in any direction may cause the creation of electron-hole pairs in the Liquid Semiconductor 20.

Figure 7:
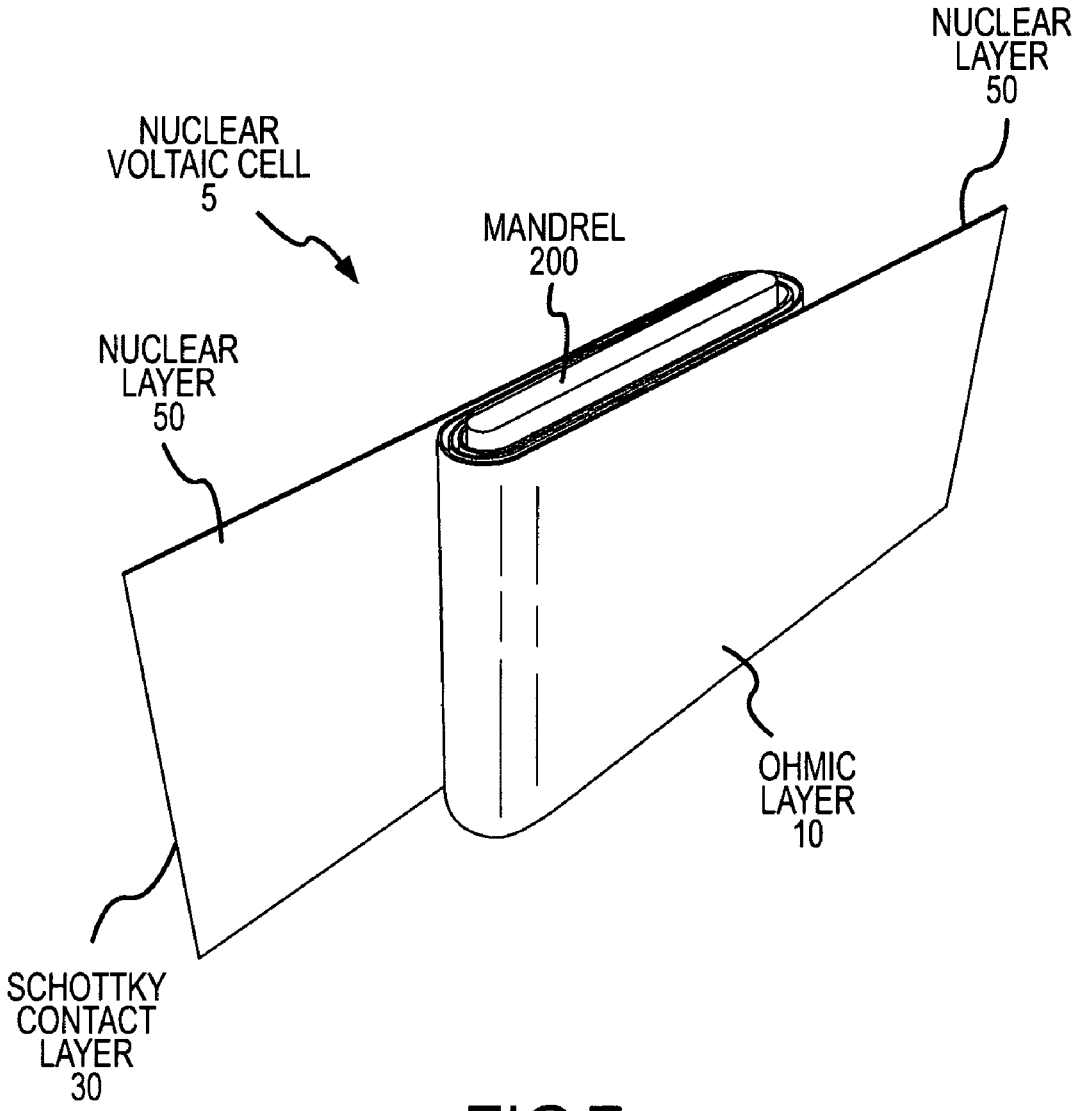
FIG. 7 shows preferred embodiments of the present invention wherein the axially is opposed layers of the present invention are wound around a mandrel.

FIG. 7 shows a preferred embodiment of the present invention in which the axially opposed layers of the present invention, as described in FIG. 1, are wound around a Mandrel 200 to create a single Nuclear Voltaic Cell 5 with characteristics similar to a chemical cell. The advantage of this preferred embodiment of the present invention is that it minimizes the volume of the present invention and provides for stability since long, thin Nuclear Voltaic Cells 5 that are wound around a Mandrel 200 are mechanically sturdy. In an alternative embodiment, the axially opposed layers of the Nuclear Voltaic Cell 5 may be stacked on top of each other; however, this does not reduce the volume of the present invention as much as the winding method described above, since a means must be provided for maintaining the mechanical integrity of the stack.

Figure 8:
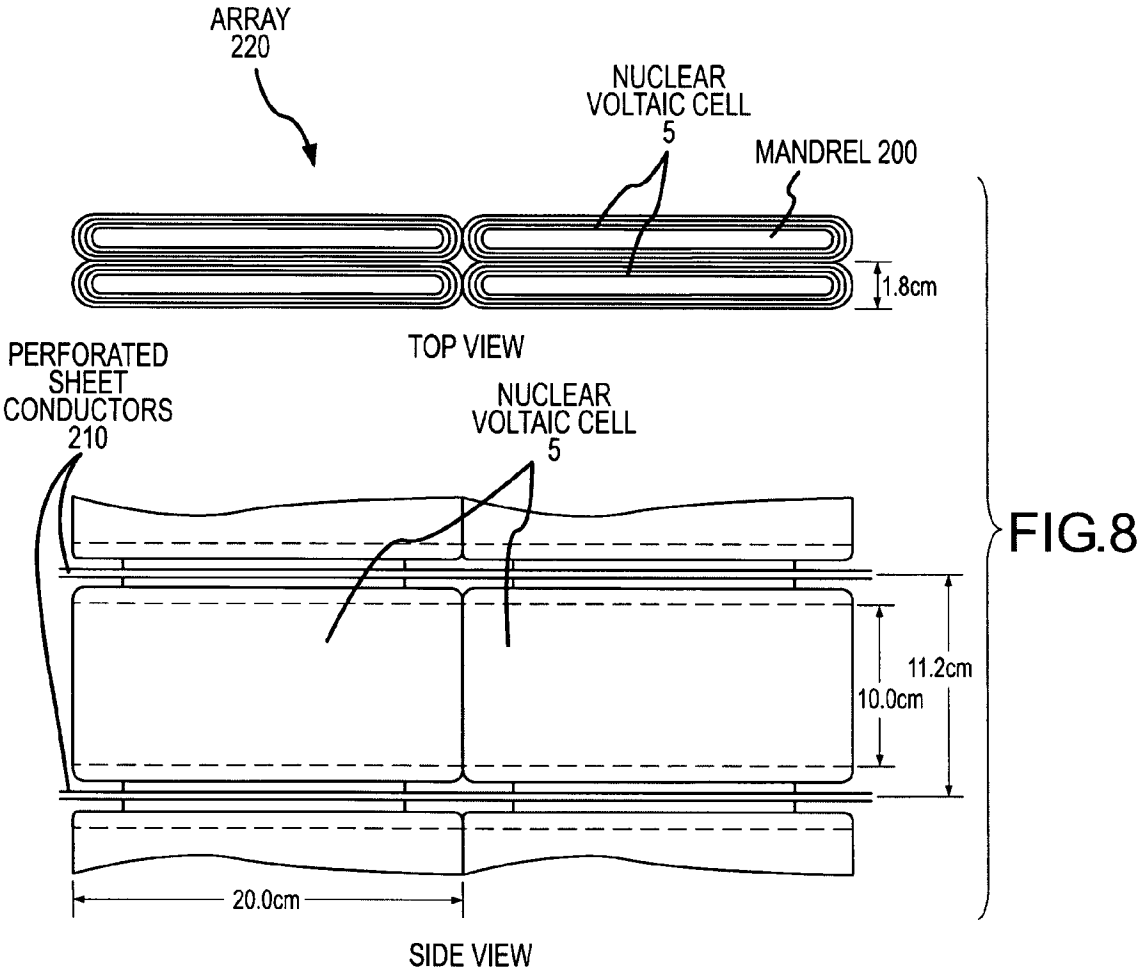
FIG. 8 shows how in a preferred embodiment of the present invention multiple nuclear voltaic cells are connected to create an array.

FIG. 8 shows how, in a preferred embodiment of the present invention, multiple Nuclear Voltaic Cells 5 may be connected using Perforated Sheet Conductors 210 to create an Array 220. In this preferred embodiment, by connecting the Nuclear Voltaic Cells 5 into an Array 220, the power produced by each Nuclear Voltaic Cell 5 may be combined for greater electrical power generation. The number of Nuclear Voltaic Cells 5 used in the Array 220 may be varied depending upon the amount of electrical energy required. Because the Nuclear Voltaic Cells 5 are connected in a series/parallel fashion, if one Nuclear Voltaic Cell 5 fails, the rest of the Array 220 will continue to function.

Figure 9:
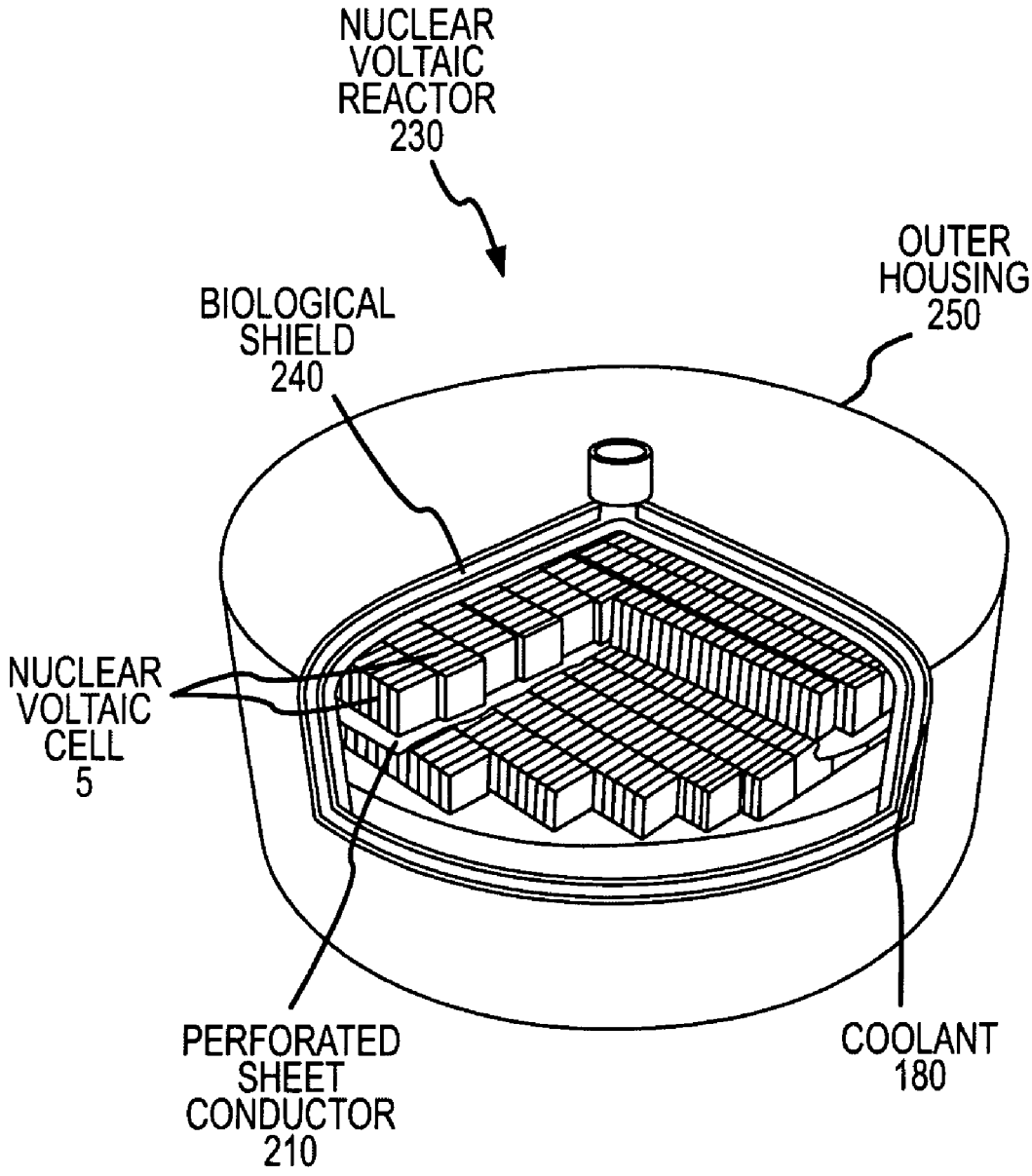
FIG. 9 shows how in a preferred embodiment of the present invention multiple nuclear voltaic cells are combined to create a nuclear voltaic reactor.

FIG. 9 shows a preferred embodiment of the present invention whereby multiple Nuclear Voltaic Cells 5 are combined to create a Nuclear Voltaic Reactor 230. In this embodiment, individual Nuclear Voltaic Cells 5 are connected using a Perforated Sheet Conductor 210. In a preferred embodiment of the present invention, a Biological Shield 240 and an Outer Housing 250 are provided that surround the assembly of Nuclear Voltaic Cells 5 to prevent the escape of any radiation.

A Coolant 180 is pumped around the inside of the Nuclear Voltaic Reactor 230, between the Biological Shield 240 and the Outer Housing 250, to prevent overheating. In a preferred embodiment of the present invention, the Coolant 180 is a Liquid Semiconductor 20. In this way, the Liquid Semiconductor 20 may be used both to cool the Nuclear Voltaic Reactor 230 and to produce electric power.

Figure 10:
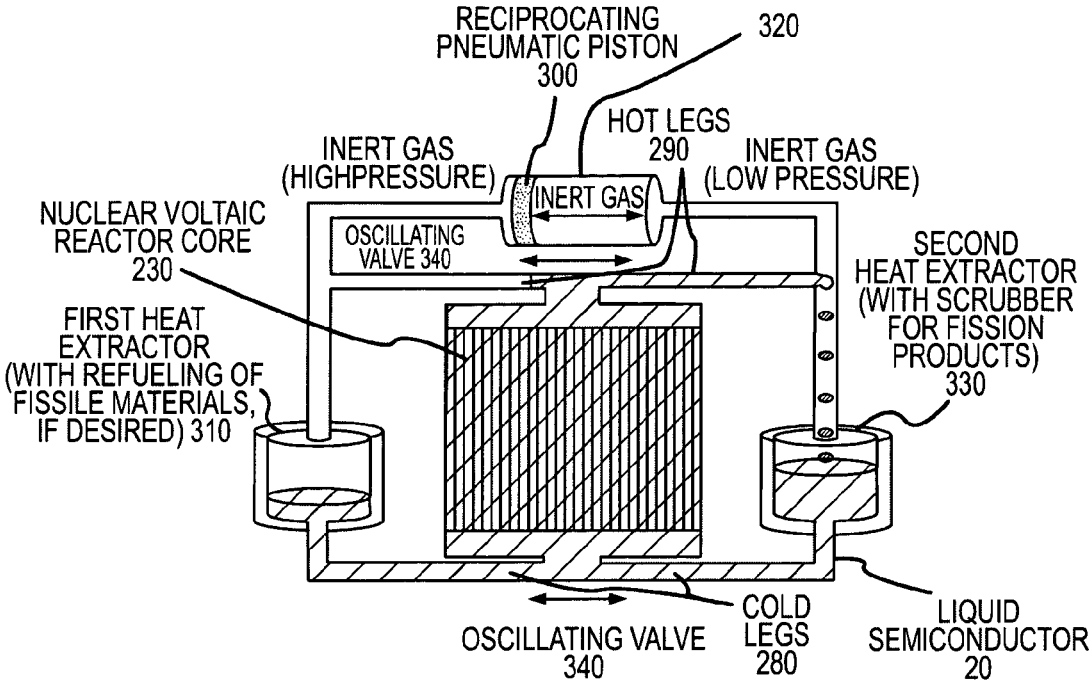
FIG. 10 shows a preferred embodiment of the present invention wherein the coolant and the liquid semiconductor are circulated through the nuclear voltaic cell reactor.

FIG. 10 shows a preferred embodiment of the present invention wherein the Liquid Semiconductor 20 is circulated from the Cold Legs 280 through the Nuclear Voltaic Reactor Core 230 to the Hot Legs 290, serving as coolant for removing waste heat (fission fragment energy not converted into electricity) as well as performing energy conversion. In this preferred embodiment, chilled Liquid Semiconductor 20 is made to flow by the Reciprocating Pneumatic Piston 300. The Reciprocating Pneumatic Piston 300 compresses an Inert Gas 320 causing the Liquid Semiconductor 20 to flow from the First Heat Extractor 310 through the Nuclear Voltaic Reactor Core 230, where it provides for attaining nuclear criticality, energy conversion, and cooling. The Liquid Semiconductor 20 then flows into the Second Heat Extractor 330 at low inert gas pressure, flow direction being governed by Oscillating Valves 340 and the direction of the Reciprocating Pneumatic Piston 300 movement. When the Second Heat Extractor 330 is filled, the Oscillating Valves 340 change position and the Reciprocating Pneumatic Piston 300 reverses direction to force chilled coolant from the Second Heat Extractor 330 through the Nuclear Voltaic Core 230 to the First Heat Extractor 310 for continuous quiet cooling. The heat removed can also be used to produce auxiliary electrical power via the conventional heat exchange process (e.g., thermoelectric converters). Similarly, by combining a scrubbing mechanism with the Second Heat Extractor 330, the Liquid Semiconductor 20 can flow intermittently into the Second Heat Extractor 330 where unwanted pieces of fission fragment material and unwanted neutron activation products can be removed from the Liquid Semiconductor 20. This is a preferred embodiment of the current invention as it allows for the present invention to be a self-contained system in which there is continuous cooling and purification or scrubbing wherein the Liquid Semiconductor 20 is continuously used without the need for adding new Liquid Semiconductor 20 when the Liquid Semiconductor 20 becomes too contaminated with Fission Fragments 140 and neutron activation products.

In combination with the scrubbing of fission fragments and of neutron activation products, fissile material may be added intermittently in the First Heat Extractor 310 to replace the fissile material burned up in the fission process to sustain a critical nuclear condition in the reactor.

Figure 11:
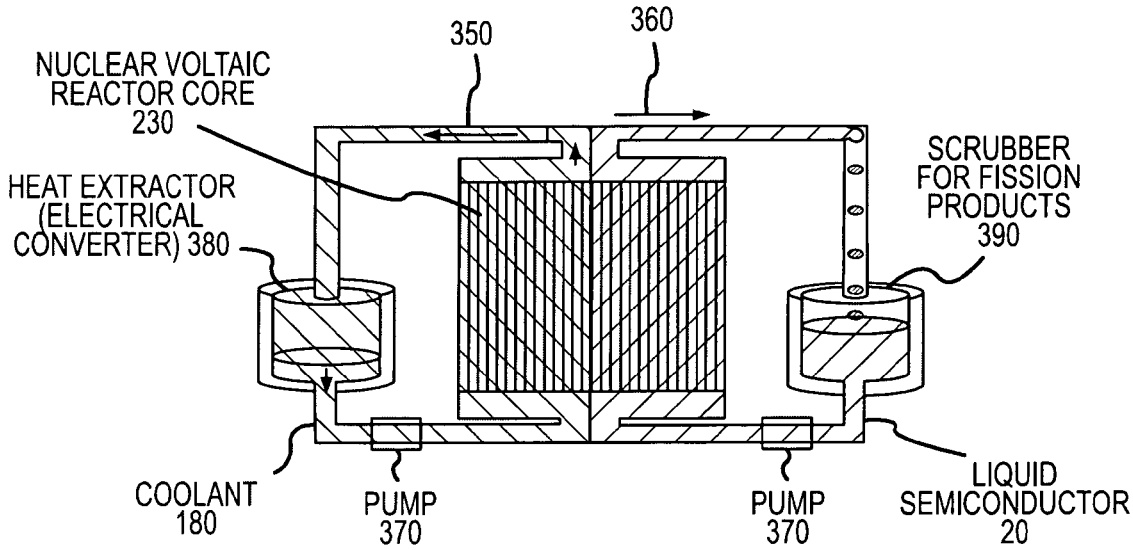
FIG. 11 shows how, in a preferred embodiment of the present invention, the coolant loop and energy conversion/fission fragment scrubber loop are separated from each other.

FIG. 11 shows an embodiment of the present invention wherein the Coolant 180, which may or may not be a Liquid Semiconductor 20, accomplishes the coolant phase. The Coolant 180 and the Liquid Semiconductor 20 are in separate loops circulated through the Nuclear Voltaic Reactor Core 230. In this preferred embodiment, a first Pump 370 is used to pump the Coolant 180 to flow in the direction of the Arrow 350, and the Liquid Semiconductor 20 is pumped by a second Pump 370 to flow in the direction of the Arrow 360. The Coolant 180 flows into a Heat Extractor 380 that allows for the removal of heat energy so that the Coolant 180 can be used as a means for continuous cooling. The heat removed can also be used to produce auxiliary electrical power via the conventional heat exchange process (e.g., thermoelectric converters). The Liquid Semiconductor 20 is pumped to flow through the Scrubber 390 where unwanted pieces of fission fragment material and unwanted neutron activation products can be removed from the Liquid Semiconductor 20.

Having described the present invention, it will be understood by those skilled in the art that many changes in construction and circuitry and widely different embodiments and applications of the invention will suggest themselves without departing from the scope of the present invention.

What is claimed is:

1. A nuclear voltaic cell configured to generate an electrical current, comprising:

a first metal contact layer having a first side;

a second metal contact layer having a first side, wherein said first side of said second metal contact layer is positioned facing said first side of said first metal contact layer and forms a channel between said first and second metal contact layers;

a liquid semiconductor located within said channel and in contact with said first side of said first metal contact layer and in contact with said first side of said second metal contact layer, wherein said liquid semiconductor contains a radioactive isotope in solution and said first side of said first metal contact layer forms a Schottky contact with said liquid semiconductor, and said first side of said second metal contact layer forms a low resistance or ohmic contact with said liquid semiconductor, and wherein said liquid semiconductor comprises at least one chalcogen, said chalcogen selected from the group consisting essentially of sulfur, selenium and tellurium; and an electrical circuit connecting said first metal contact layer to said second metal contact layer.

2. A nuclear voltaic cell according to claim 1 further comprising:

an electrical load connected to said electrical circuit, wherein electrical power is generated when said electrical load is connected to said electrical circuit.

3. A nuclear voltaic cell according to claim 1, wherein said liquid semiconductor is a p-type semiconductor.

4. A nuclear voltaic cell according to claim 1, further comprising:

a plurality of nonconductive spacers abutted between said first side of said first metal contact layer and said first side of said second metal contact layer to maintain said channel between said first and second metal contact layers, wherein with said liquid semiconductor within said channel surrounds said plurality of nonconductive spacers.

5. A nuclear voltaic cell according to claim 1, wherein said liquid semiconductor flows through said channel between said first metal contact layer and said second metal contact layer.

6. A nuclear voltaic cell according to claim 1, further comprising:

a mandrel, wherein said first metal contact layer and said second metal contact layer with said channel therebetween are wound around said mandrel to form the cell.

7. A nuclear voltaic cell according to claim 1, further comprising at least one nonconductive spacer situated between said first side of said first metal contact layer and said first side of said second metal contact layer to maintain said channel between said first and second metal contact layers.

8. A nuclear voltaic cell according to claim 1, wherein said liquid semiconductor comprises selenium.

9. A nuclear voltaic cell according to claim 1, wherein said liquid semiconductor is a mixture comprising said chalcogen.

10. A nuclear voltaic cell according to claim 1, wherein said liquid semiconductor is an alloy comprising said at least one chalcogen and a metal.

* * * * *